US005494321A

United States Patent [19]

Ishihara et al.

[11] Patent Number: 5,494,321

[45] Date of Patent: Feb. 27, 1996

[54] VEHICLE DOOR LOCK MECHANISM

[75] Inventors: Hiroshi Ishihara; Yoshinobu Ogura, both of Kariya, Japan

[73] Assignee: Aisin Seiki Kabushiki Kaisha, Kariya, Japan

[21] Appl. No.: 111,538

[22] Filed: Aug. 25, 1993

[30] Foreign Application Priority Data

Aug. 31, 1992 [JP] Japan ..... 4-232147

[51] Int. Cl.[6] ..... E05C 3/06

[52] U.S. Cl. ..... 242/216; 292/DIG. 23

[58] Field of Search ..... 292/216, 217, 292/DIG. 23

[56] References Cited

U.S. PATENT DOCUMENTS

| | | | |
|---|---|---|---|
| 5,005,882 | 4/1991 | Fukumoto et al. | 292/216 |
| 5,046,769 | 9/1991 | Rimbey et al. | 292/216 |
| 5,054,827 | 10/1991 | Kochan et al. | 292/216 |
| 5,071,178 | 12/1991 | Brackman et al. | 292/216 |
| 5,074,603 | 12/1991 | Brackman et al. | 292/216 |
| 5,181,754 | 1/1993 | Shibata | 292/216 |
| 5,192,103 | 3/1993 | Fukumoto et al. | 292/216 |

FOREIGN PATENT DOCUMENTS 2-96073 6/1990 Japan .

*Primary Examiner*—Steven N. Meyers
*Assistant Examiner*—Monica E. Millner
*Attorney, Agent, or Firm*—Burns, Doane, Swecker & Mathis

[57] ABSTRACT

A vehicle door locking assembly includes a housing, a latch member and a pawl member provided in the housing for holding a vehicle door in a closed position, a manually actuatable door opening member provided on the housing for rotational movement, and a rotatably mounted lift lever which is operatively connected with the latch member. A release lever is mounted on the door opening member for rotational movement between a first position in which the release lever engages the lift lever so that rotational movement of the door opening member is transmitted through the release lever and the lift lever to the pawl member to release the door and a second position in which the release lever cannot engage the lift lever so that rotational movement of the door opening member is not transmitted to the lift lever. A locking lever is mounted for rotational movement on the housing between a locking position and an unlocking position, and is operatively connected with the release lever so that when the locking lever is moved to the locking position the release lever is moved to the second position in which the release lever cannot be engaged with the lift lever and so that when the locking lever is moved to the unlocking position the release lever is moved to the first position in which the release lever can be engaged with the lift lever upon operation of the door opening member.

2 Claims, 4 Drawing Sheets

VEHICLE DOOR LOCK MECHANISM

BACKGROUND OF THE INVENTION

1. Field of the Invention

The present invention relates to a door lock mechanism and more particularly to a vehicle door lock mechanism.

2. Description of the Prior Art

The Japanese Patent Disclosure No. Hei-2-96073 discloses a vehicle door lock mechanism having a door opening manually operable lever supporting a release bush which can be slidably moved by means of a locking lever between an unlock position and a locking position. In the unlock position, the release bush is positioned for engagement with a lift lever so that the latch mechanism can be actuated to open the door through an operation of the door opening lever, the movement of the door opening lever being transmitted through the release lever and the lift lever to the latch mechanism. In the lock position, the release bush is positioned so it cannot be engaged with the lift lever so that the latch mechanism cannot be actuated through the operation of the door opening lever.

As described, the conventional door lock mechanism includes a slidably mounted release bush which is slidably moved between an unlock position and a lock position. Therefore, the conventional door lock mechanism requires a space wherein the slidably mounted release bush can be accommodated both in the unlock position and the lock position. For this reason, the door lock mechanism of the conventional structure becomes bulky.

SUMMARY OF THE INVENTION

It is therefore an object of the present invention to provide a vehicle door lock mechanism which is small in size so that it can be mounted in a relatively small space.

Another object of the present invention is to provide a vehicle door lock mechanism which does not include a slidable release bush as in the conventional mechanism.

According to the present invention, the above and other objects can be accomplished by substituting the release bush in the conventional door lock mechanism by a release lever which is mounted for a pivotable movement on a door opening manually actuatable lever. The release lever is pivotably moved between an unlock position wherein it is engageable with a lift lever and a lock position wherein it cannot be engaged with the lift lever.

According to the feature of the present invention, the release member is of a pivotable type so that it does not require a space for a slidable movement. Thus, the whole mechanism can be housed in a compact space.

Thus, according to one aspect of the present invention, there is provided a vehicle door lock assembly comprising housing means, a latch member provided in the housing means for holding a vehicle door in a closed position, a manually actuatable door opening member provided on the housing means for a rotational movement, a lift lever provided on the housing means for a rotational movement about a pivot axis and operatively connected with the latch member so that a rotational movement of the lift lever is transmitted to the latch member to move the latch member between a door release position and a door latch position, a release lever mounted on the door opening member for a rotational movement between a first position wherein it is engageable with the lift lever so that a rotational movement of the door opening member is transmitted through the release lever and the lift lever to the latch member to release the door and a second position wherein it cannot be engaged with the lift lever so that the rotational movement of the door opening member is not transmitted to the lift lever, means for rotationally moving the release lever.

According to a preferable aspect of the present invention, the last mentioned means is in the form of a locking lever which is mounted for a rotational movement on the housing means between a locking position and an unlocking position and operatively connected with the release lever so that when the locking lever is moved to the locking position the release lever is moved to the second position wherein the release lever cannot be engaged with the lift lever and when the locking lever is moved to the unlocking position the release lever is moved to the first position wherein the release lever can be engaged with the lift lever upon an operation of the door opening member.

According to a specific feature of the present invention, the locking lever is formed with a slot which includes a first arcuate portion extending along an arc having a center of arc lying on the pivot axis of the lift lever and a second substantially straight portion, the release lever having a slider provided thereon and engaged with the slot in the locking lever so that a rotation of the locking lever causes a rotation of the release lever by having the slider slidably moved along the slot from the first portion to the second portion. Preferably, the slot in the locking lever is formed so that in the locked position the slider is located on the pivot axis of the lift lever. With this arrangement, it is possible to have the lift lever unaffected by the movement of the release lever.

The above and other objects and features of the present invention will become apparent from the following description of a preferred embodiment taking reference to the accompanying drawings.

DESCRIPTION OF THE PREFERRED EMBODIMENT

Figure 1:
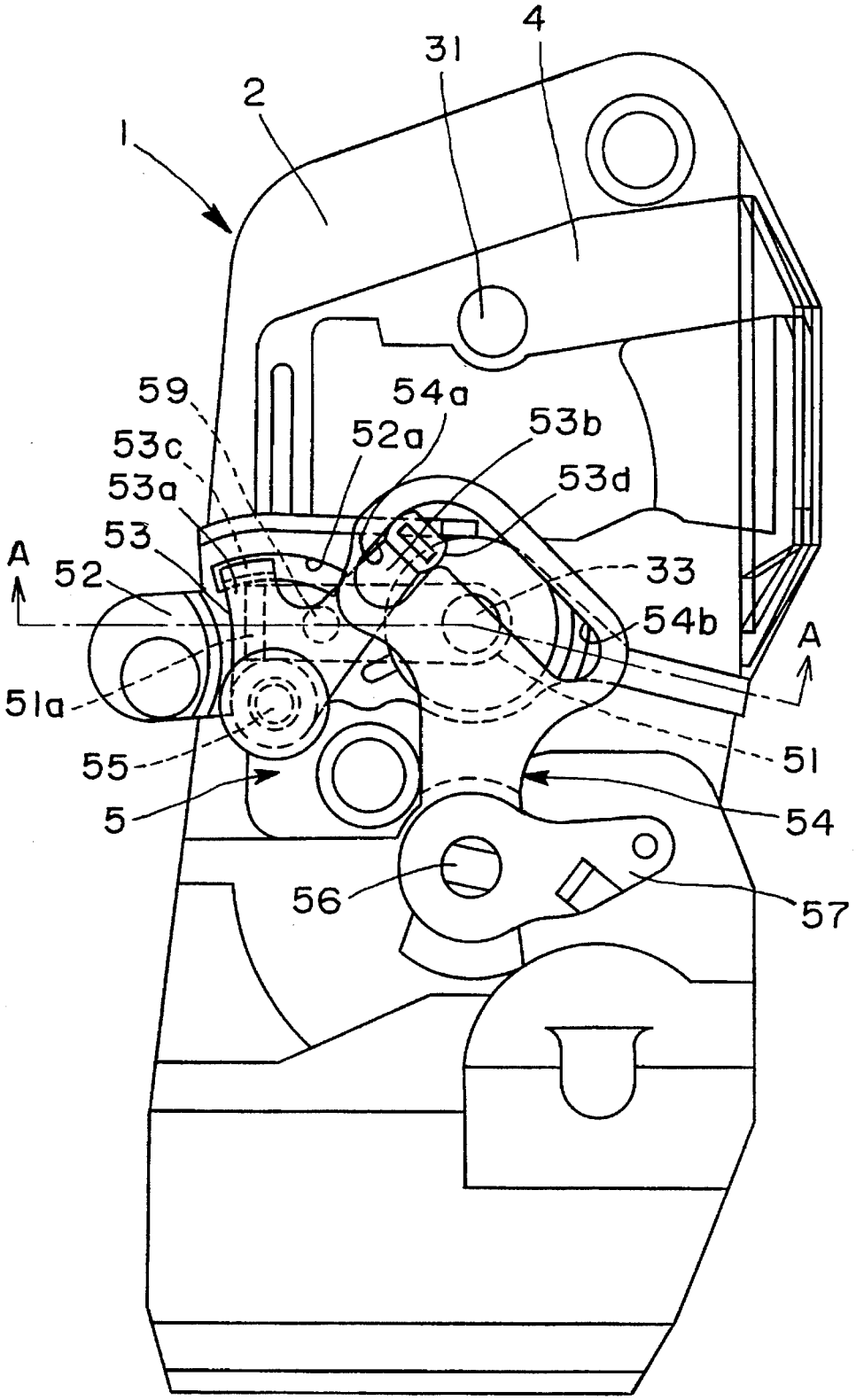
FIG. 1 is a plan view of a vehicle door lock mechanism in accordance with one embodiment of the present invention showing the mechanism in the unlock position.
Figure 2:
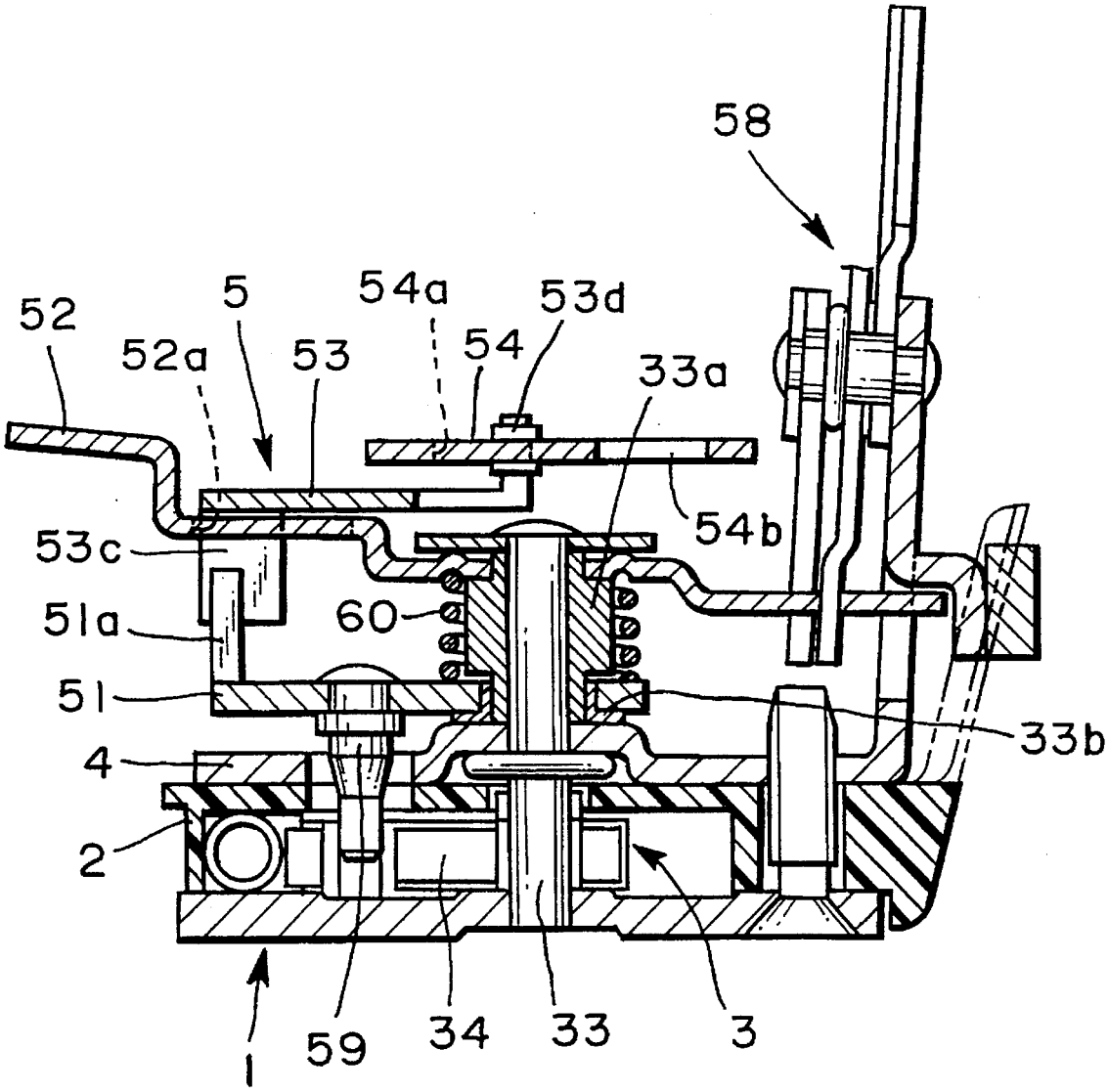
FIG. 2 is a sectional view taken substantially along the line A—A in FIG. 1.
Figure 3:
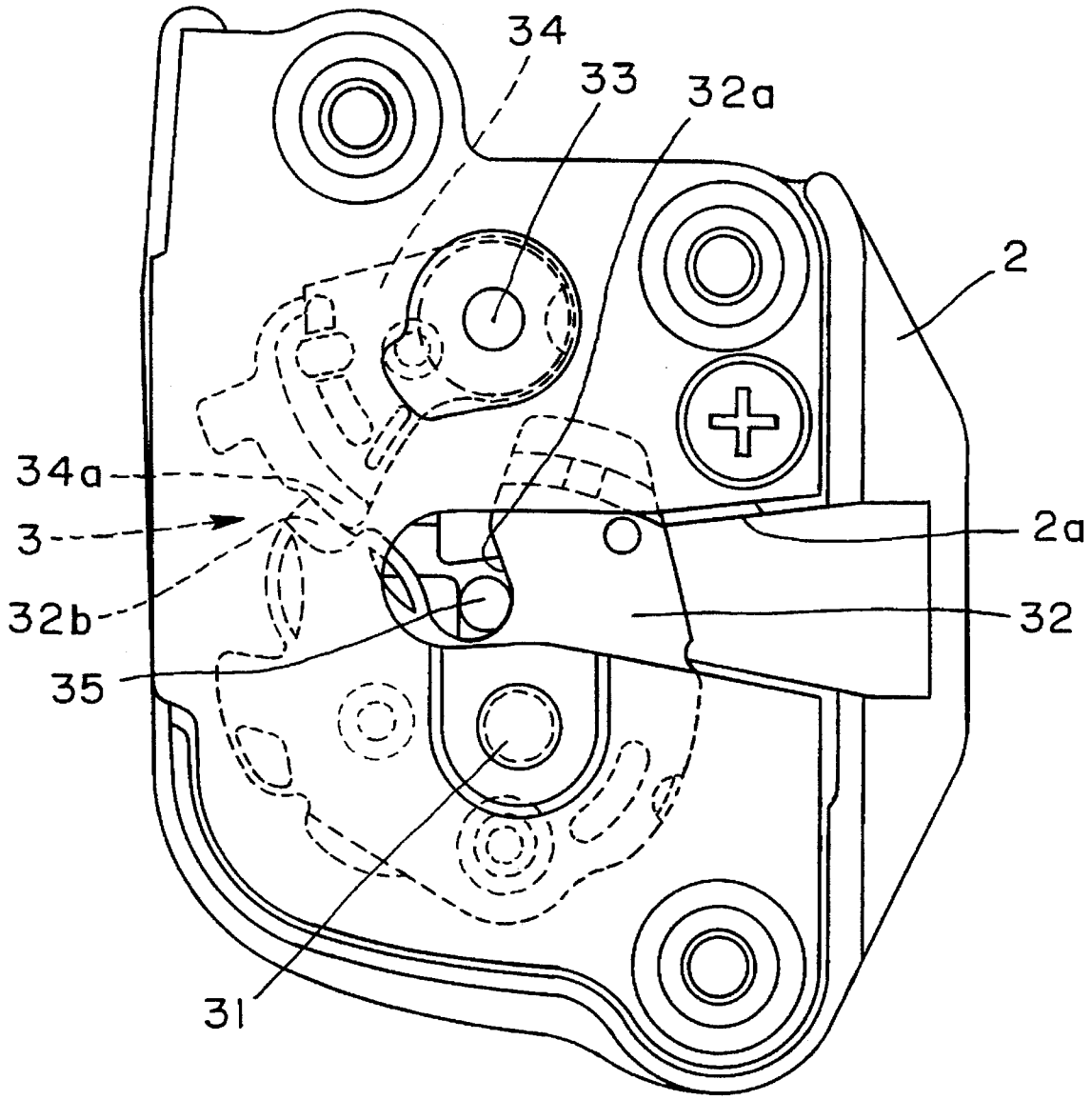
FIG. 3 is a plan view showing the latch mechanism of the locking mechanism; and, FIG. 4 is a plan view of the door locking mechanism similar to FIG. 1 but showing the mechanism in the lock position.

Referring to the drawings, particularly to FIGS. 1 and 2, there is shown a vehicle door lock assembly 1 which includes a latch mechanism 3 provided in a housing and a locking mechanism 5 which is mounted on the housing. As shown in FIG. 3, the latch mechanism 3 includes a latch member 32 mounted on the housing 2 for rotation by means of a latch pin 31 and a pawl 34 mounted on the housing for rotation by means of a pawl pin 33.

As well known in the art, the housing 2 is formed at one side with a cutout **2*a* which extends transversely from one side edge of the housing 2 to an intermediate portion of the housing 2. The lock assembly 1 is mounted on a side edge portion of a vehicle door (not shown) in a position wherein a striker 35 mounted on a vehicle body (not shown) can be received in the cutout 2***a* when the door is closed. The latch member 32 is formed with a striker receiving groove 32*a* so that the striker 35 is received in this groove 32*a* when the door is closed as in a conventional structure. As well known in the art, the striker receiving groove 32*a* in the latch member 32 is formed in such a manner that when the door is closed and the striker 35 is passed through the cutout 2*a* in the housing 2 into the striker receiving groove 32*a* in the latch member 32 the latch member 32 is rotated counterclockwise under the force applied by the striker 35 to the latch member 32.

The latch member 32 is formed at one side of the striker receiving groove 32*a* with an abutting pawl 32*b*. The pawl 34 is formed at a free end with an abutting pawl portion 34*a* and positioned such that the abutting pawl portion 34*a* engages the abutting pawl 32*b* of the latch member 32 when the latch member 32 is rotated counterclockwise as shown in FIG. 3. As in a conventional structure, the latch member 32 is spring biased clockwise as seen in the plane of FIG. 3. The pawl 34 is spring biased counterclockwise as seen in the plane of FIG. 3. In the latching position shown in FIG. 3, the latching mechanism can be moved to a release position by rotating the pawl 34 clockwise in the plane of FIG. 3.

Referring again to FIGS. 1 and 2, it will be noted that the locking mechanism 5 includes a lift lever 51 which is mounted on the housing through the pawl pin 33 for rotation about the axis of the pawl pin 33. As shown in FIG. 2, a sleeve 33*a* is mounted on the pawl pin 33 and a bush 33*b* is mounted on the sleeve 33*a* at the lower end portion thereof. The lift lever 51 is thus mounted on the pawl pin 33 through the sleeve 33*a* and the bush 33*b*. It will be noted in FIG. 2 that the lift lever 51 is provided with a connecting pin 59 which is inserted into the pawl 34 so that the pawl 34 is rotated as a unit with the lift lever 51 to release the latch member 32.

Above the lift lever 51, there is provided a door opening lever 52 which is mounted for rotation on the housing 2. The door opening lever 52 is mounted on the upper end portion of the sleeve 33*a* on the pawl pin 33 for rotation about the axis of the pawl pin 33. The door opening lever 52 is connected with a lever mechanism 58 which is in turn connected with manually actuatable members provided respectively on the outer side and the inner side of the door assembly. Thus, the door opening lever 52 is manually actuated to release the latch mechanism 3.

The door opening lever 52 carries a release lever 53 which is mounted on the lever 52 by means of a pivot pin 55 for rotation about the axis of the pin 55. In FIG. 1, it will be noted that the door opening lever 52 is formed with an arcuate slot 52*a* which extends along an arc having a center of arc on the axis of the pin 55. The release lever 53 is of a bifurcated shape having two arms 53*a* and 53*b* as shown in FIG. 1. The release lever 53 is formed at a free end of one of the arms 53*a* with a downwardly extending pawl 53*c* which is passed downwardly through the slot 52*a* in the door opening lever 52. The lift lever 51 is formed at a free end with an upwardly extending pawl 51*a*. It will be noted in FIG. 1 that in the position of the release lever 53 shown in FIG. 1 the pawl 53*c* on the release lever can engage the pawl 51*a* on the lift lever 51 so that a counterclockwise rotation of the door opening lever 52 is transmitted through the release lever 53 and the pawls 53*c* and 51*a* to the lift lever 51 to thereby rotate the pawl 34 to the release position. When the release lever 53 is rotated clockwise from the position shown in FIG. 1, the pawl 53*c* is moved along the arcuate slot 52*a* to a position wherein it does not engage the pawl 51*a* on the lift lever 51. In this position of the release lever 53, the rotation of the door opening lever 52 is not transmitted to the lift lever 51 so that the pawl 34 is not moved into the release position.

In order to produce the aforementioned rotation of the release lever 53, there is provided a locking lever 54 which can best be seen in FIG. 1. The locking lever 54 is mounted on the housing 2 by means of a pivot shaft 56 to rotate about the axis of the shaft 56. The locking lever 54 is rotatable about the axis of the shaft 56 between an unlock position which is shown in FIG. 1 and a lock position wherein the lever 54 is rotated counterclockwise from the position shown in FIG. 1. The locking lever 54 is connected with a lever 57 which is in turn connected with a manually actuatable locking knob (not shown) which may be provided on the door so that the locking lever can be manually operated between the unlock position and the lock position.

The locking lever is formed at a free end portion with a slot which comprises a first slot portion 54*a* and a second slot portion 54*b*. The first slot portion is of an arcuate shape extending along an arc having a center of arc lying on the axis of the pawl pin 33. The second slot portion 54*b* is substantially straight and extends from an end of the first slot portion 54*a*.

The release lever 53 is provided at a free end of the arm portion 53*b* with a slider 53*d* which is engaged with the slot in the locking lever 54. In the unlock position shown in FIG. 1, the slider 53*d* on the release lever 53 engages the arcuate first slot portion 54*a*. When the locking lever 54 is rotated counterclockwise from the position shown in FIG. 1, the slider 53*d* is moved from the first slot portion 54*a* to the second slot portion 54*b*. The second slot portion 54*b* is formed so that the release lever 53 is rotated clockwise from the position shown in FIG. 1 to the position shown in FIG. 4 when the slider is moved into the second slot portion 54*b* as described previously to the position wherein the pawl 53*c* on the release lever 53 does not engage the pawl 51*a* on the lift lever 51. The second slot portion 54*b* is located so that when the release lever 54 is rotated counterclockwise and the release lever 53 is rotated clockwise as previously described the slider is located concentrically with the pawl pin 33 as shown in FIG. 4.

In operation, the door lock assembly 1 is in the unlock position when the parts of the assembly 1 are in positions shown in FIG. 1. In this position, the pawl 53*c* on the release lever 53 is engageable with the pawl 51*a* on the lift lever 51. When the door open lever 52 is manually actuated counterclockwise, the rotation of the door open lever 52 is transmitted through the pawl 53*c* to the release lever. The rotation of the release lever 53 is then transmitted through the pawls 53*c* and 51*a* to the lift lever 51. Thus, the pawl 34 is rotated by the lift lever 51 clockwise from the position shown in FIG. 3 to release the latch lever 32 to allow the door to be opened.

Figure 4:
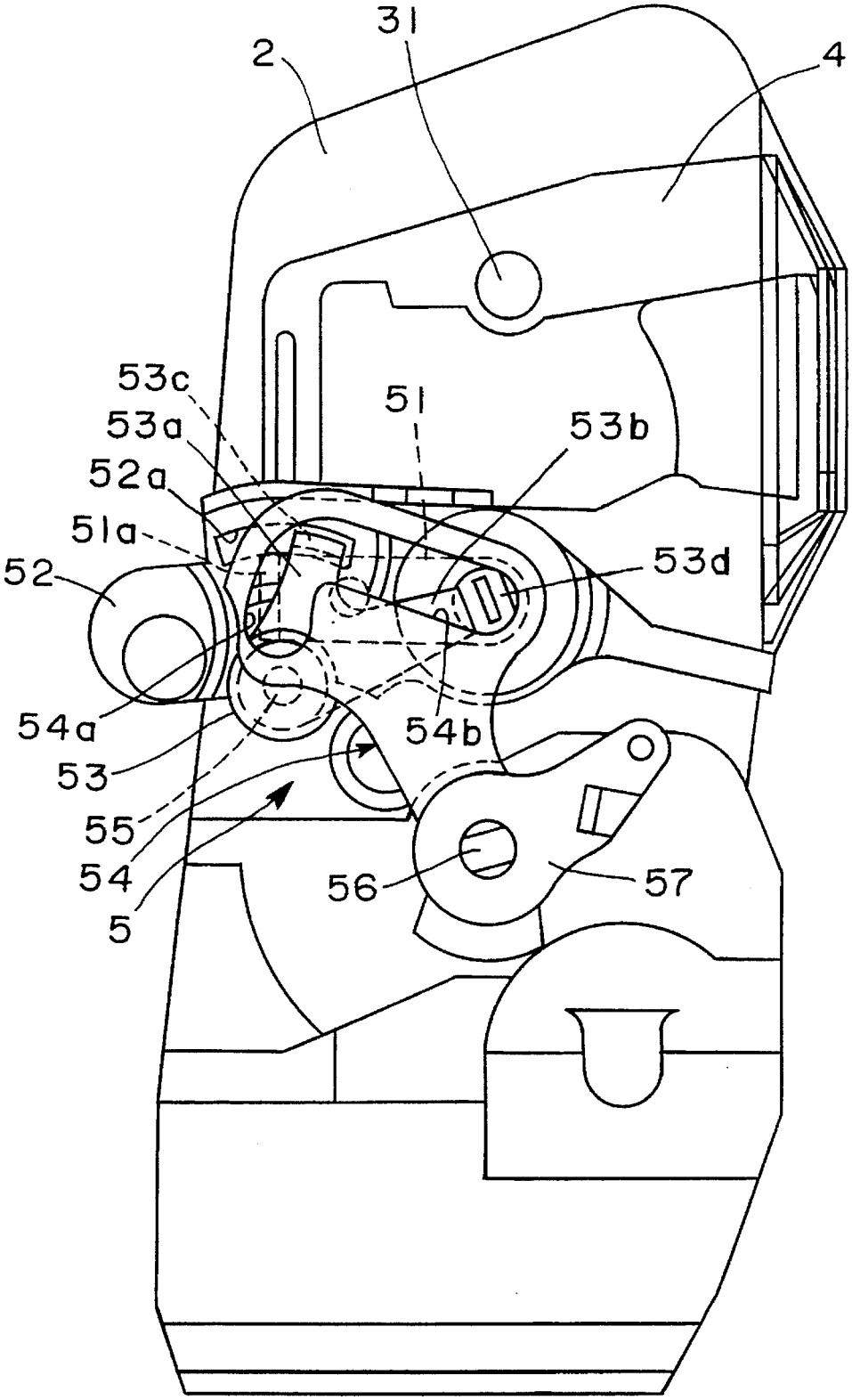

When the locking lever 54 is rotated manually in the counterclockwise direction, the slider 53*d* on the release lever 53 is moved from the first slot portion 54*a* to the second slot portion 54*b* to produce a clockwise rotation of the release lever 53 as shown in FIG. 4. In this position, a rotation of the door opening lever 52 is not transmitted to the lift lever 51 so that the pawl 34 is held in the latching position shown in FIG. 3. The feature of the present invention is that the release lever is provided rotatably so that it can be located in a relatively compact space.

The invention has thus been shown and described with reference to a specific structure however it should be noted that the invention is in no way limited to the details of the illustrated structures but changes and modifications may be made without departing from the scope of the appended claims.

We claim:

1. A vehicle door locking assembly comprising a housing, a latch member and a pawl member provided in said housing for holding a vehicle door in a closed position, a manually actuatable door opening member provided on said housing for moving in a rotational manner, a lift lever provided on said housing for moving in a rotational manner about a pivot axis, said lift lever having an upwardly extending pawl and being operatively connected with said pawl member so that rotational movement of said lift lever is transmitted to said latch member to move said latch member between a door release position and a door latch position, a release lever having a segment which extends toward said housing through an arcuate slot in said door opening member, said release lever being mounted for rotational movement between a first position in which said segment of said release lever is engageable with the pawl of said lift lever so that rotational movement of said door opening member is transmitted through said release lever and said lift lever to said pawl member to release said door and a second position in which the segment of the release lever cannot be engaged with the pawl of said lift lever so that rotational movement of said door opening member is not transmitted to said lift lever, and a locking lever for rotationally moving said release lever, said locking lever being mounted for rotational movement on said housing between a locking position and an unlocking position, said locking lever being operatively connected with said release lever so that when said locking lever is moved to said locking position said release lever is moved to the second position and when said locking lever is moved to the unlocking position said release lever is moved to the first position, said locking lever being formed with a slot which includes a first arcuate portion extending along an arc having a center of curvature lying on the pivot axis of said lift lever and a second substantially straight portion, said release lever having a slider provided thereon which engages the slot in said locking lever so that rotation of the locking lever causes rotation of the release lever as a result of the slider slidably moving along the slot from the first portion to the second portion.

2. A vehicle door locking assembly comprising a housing, a latch member and a pawl member provided in said housing for holding a vehicle door in a closed position, a manually actuatable door opening member provided on said housing for moving in a rotational manner, a lift lever provided on said housing for moving in a rotational manner about a pivot axis, said lift lever having an upwardly extending pawl and being operatively connected with said pawl member so that rotational movement of said lift lever is transmitted to said latch member to move said latch member between a door release position and a door latch position, a release lever having a segment which extends toward said housing through an arcuate slot in said door opening member, said release lever being mounted for rotational movement between a first position in which said segment of said release lever is engageable with the pawl of said lift lever so that rotational movement of said door opening member is transmitted through said release lever and said lift lever to said pawl member to release said door and a second position in which the segment of the release lever cannot be engaged with the pawl of said lift lever so that rotational movement of said door opening member is not transmitted to said lift lever, and a locking lever for rotationally moving said release lever, said locking lever being mounted for rotational movement on said housing between a locking position and an unlocking position, said locking lever being operatively connected with said release lever so that when said locking lever is moved to said locking position said release lever is moved to the second position and when said locking lever is moved to the unlocking position said release lever is moved to the first position, said locking lever being formed with a slot which includes a first arcuate portion extending along an arc having a center of curvature lying on the pivot axis of said lift lever and a second substantially straight portion, said release lever having a slider provided thereon which engages the slot in said locking lever so that rotation of the locking lever causes rotation of the release lever as a result of the slider slidably moving along the slot from the first portion to the second portion, the slot in the locking lever being formed so that in the locked position the slider is located on the pivot axis of the lift lever.

* * * * *